United States Patent [19]

Nilsson et al.

[11] 4,416,068

[45] Nov. 22, 1983

[54] APPARATUS FOR SURFACE TREATMENT OF OBJECTS

[75] Inventors: Hans E. Nilsson, Henån; Åke Carlsson, Trollhättan, both of Sweden

[73] Assignee: Infrarodteknik AB, Vanersborg, Sweden

[21] Appl. No.: 327,232

[22] Filed: Dec. 3, 1981

[30] Foreign Application Priority Data

Dec. 11, 1980 [SE] Sweden ..... 8008707
Feb. 27, 1981 [SE] Sweden ..... 8101282

[51] Int. Cl.[3] ..... F26B 23/04

[52] U.S. Cl. ..... 34/4; 34/39; 34/68; 34/229; 34/243 R; 118/642

[58] Field of Search ..... 118/642, 643; 34/4, 34/40, 39, 68, 222, 229, 243 R

[56] References Cited

U.S. PATENT DOCUMENTS

| | | | |
|---|---|---|---|
| 2,317,426 | 4/1943 | Wilson | 34/4 |
| 2,387,516 | 10/1945 | Kaminski | 34/4 |
| 2,841,684 | 7/1958 | Miskella | 34/4 |
| 3,016,442 | 1/1962 | Brach | 34/4 |

FOREIGN PATENT DOCUMENTS

| | | |
|---|---|---|
| 450617 | 7/1936 | United Kingdom . |
| 813101 | 5/1959 | United Kingdom . |
| 976823 | 12/1964 | United Kingdom . |
| 1110000 | 4/1968 | United Kingdom . |
| 1349663 | 4/1974 | United Kingdom . |
| 1409996 | 10/1975 | United Kingdom . |

*Primary Examiner*—Larry I. Schwartz

*Attorney, Agent, or Firm*—Dann, Dorfman, Herrell and Skillman

[57] ABSTRACT

The present invention concerns a method and an apparatus for accelerating the drying and/or curing of filler material, primer and top-coatings in connection with touch-up work on car bodies.

According to the apparatus of the invention, grinding, filling and spraying are accomplished in one and the same booth, whereupon a carrier containing infra-red heat radiators and/or heating-elements and/or nozzles is traversed over the car, whereby controlled heat-energy is supplied to the surface accelerating drying and/or curing process of the surface treatment material. For supplying sufficient heat-energy to the front and rear parts of the car, special reflectors are located in front of and behind the car for reflecting heat-radiation from the carrier. The carrier is divided into sections with controlled, separate energy-supply and ventilation-air both when heat-transfer is accomplished and when the carrier is located in a parking recess, from which ventilation-air passes via specially designed slots out into the booth. The ventilation-air is conducted along the infra-red-radiators and/or heating-elements/air nozzles in a laminar air flow towards the car. The ventilation air is ventilated out from the sides and the floor of the booth. The travel of the carrier over the car body and the energization of the heating is programmed with respect to a given body configuration and with respect to the touch-up work being done in order to minimize wasteful use of energy to otherwise heat parts which do not require to be heated.

16 Claims, 15 Drawing Figures

APPARATUS FOR SURFACE TREATMENT OF OBJECTS

FIELD OF THE INVENTION

The present invention relates to apparatus for the surface treatment of bodies, particularly automobiles, such as is required in the case of repairing damaged bodies and restoration of the bodies to good condition.

In repairing damaged automobile bodies, the metallic shell of the body is hammered into the original body configuration and into substantial conformity with the original outline. After such hammering, the surface is filled with a curing filler material and is sanded so as to provide a smooth contour, after which the primer is applied and finally one or several top coats of paint are applied. The refinishing operation can be accelerated by heat treatment, e.g. in order to dry or set the filler material, or to dry or pre-cure the primer before the application of the final coating or to dry one or several top coatings. The present invention provides a method and apparatus which permits the complete heat treatment of the automobile body to be accomplished in the same booth in which the work is performed without transferring the body between different work stations for rough grinding, priming, filling, fine grinding and top coating of the body.

The present invention is particularly adapted to the treatment of automobile bodies in a treatment booth in which the bodies after being previously worked into shape by beating or hammering are subjected to the afore-mentioned steps.

BACKGROUND OF THE INVENTION

Prior to the present invention the conventional technique for finishing car bodies involved the use of separate convection or infrared ovens in order to accelerate the drying or curing of the treating material. In such prior-art operations, it has been the usual practice to maintain the temperature in the oven at a relatively low level to avoid overheating of heat sensitive materials thus entailing relatively long oven procedures. This has led to the prolongation of the heat treatment and substantial consumption of time in each such step of the operation. Furthermore, the transfer of the body from one operation to the next prolongs the treatment time for the total steps in the process considerably.

In prior convection or infrared ovens, the heat treatment of the car bodies has been required to be maintained at a low level for periods of 15–60 minutes in order to avoid overheating of heat sensitive parts of the car bodies. Specifically, the roof of the car and the hood and trunk lid of the car are relatively easy to heat and maintain at the desired temperature level, but the doors and other parts of the car which contain multiple sheet metal require a substantially higher heat consumption than the afore-mentioned parts and have thus a slower temperature rise.

SUMMARY OF THE INVENTION

The present invention provides a method and apparatus for surface treatment of automobiles and other bodies which avoids the necessity for transferring the bodies between sequential operations and enables the operations and individual heat treatments to proceed in consecutive fashion with a minimum loss in energy and time.

The invention embodies a treatment or repair booth having a support on which the car body may be placed for repair and refinishing. The booth has suitable ventilation to exhaust the dust and vapors generated during the repair and refinishing operations. A carrier is provided for traversing over the car body to supply heat to the body, heating the body as required to accelerate the setting or curing of the different treating materials used in the repair operation, the heat transfer being controlled, e.g., by a computer, to apply the required amount of heat to the appropriate parts of the body without applying wasteful heat to those areas not requiring it and without applying heat in excess of the heat required by the specific operations performed. The carrier is rapidly withdrawn after the heat treatment so that further surface treatment operations may be performed on the car bodies without transferring the car bodies from the booth and so that the application of the consecutive coats may be accomplished with properly controlled heat treatment following each operation.

The present invention includes a specially designed carrier which permits for instance controlled transfer of heat radiation to the car bodies in an efficient and effective manner and including suitable ventilation means to exhaust evaporated solvents and other vapors as well as dust particles from the vicinity of the body in order to avoid explosion, conflagration or contamination.

The carrier of the present invention utilizes heat transfer to apply the desired level of heat energy to the car body. The radiating elements of the carrier are disposed so as to direct the heat over the entire surface areas of the car body, e.g. under the control of a computer whereby a single carrier may be programmed to heat treat any part of any-one of a given selection of car bodies with the proper heat to accomplish the desired purposes.

The position and/or orientation of the heat radiating elements can be deliberately chosen and reflective means are provided to direct the heat against those parts of the car bodies which may be hidden from the direct radiation of these elements.

The various preferred features and advantages of the present invention are more fully set forth hereinafter.

BRIEF DESCRIPTION OF THE DRAWINGS

A preferred embodiment of the invention is illustrated and described hereinafter with reference to the accompanying drawings wherein.

DESCRIPTION OF THE PREFERRED EMBODIMENT

Figure 1:
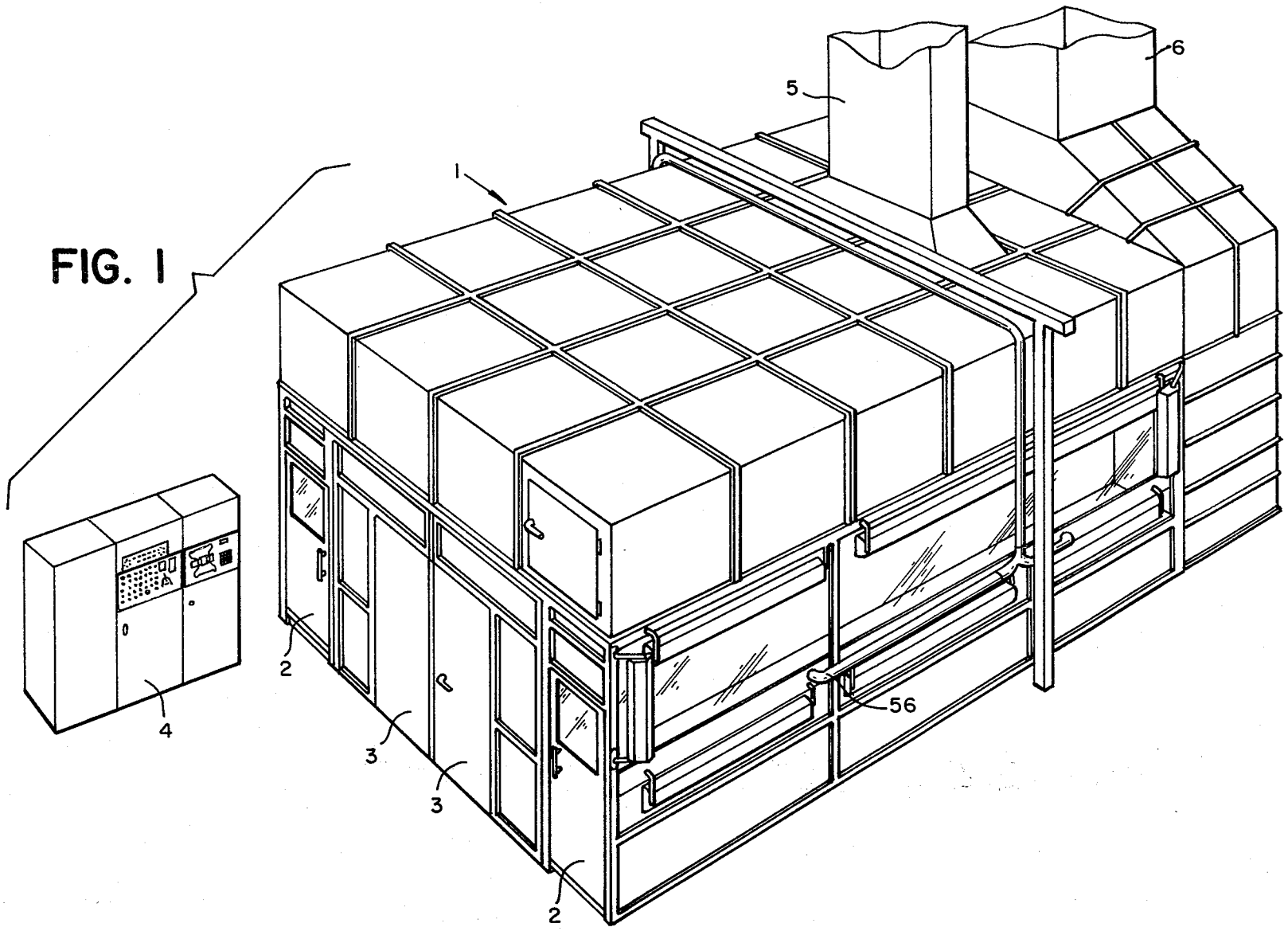
FIG. 1 is a perspective view of a repair booth embodying the present invention.
Figure 2:
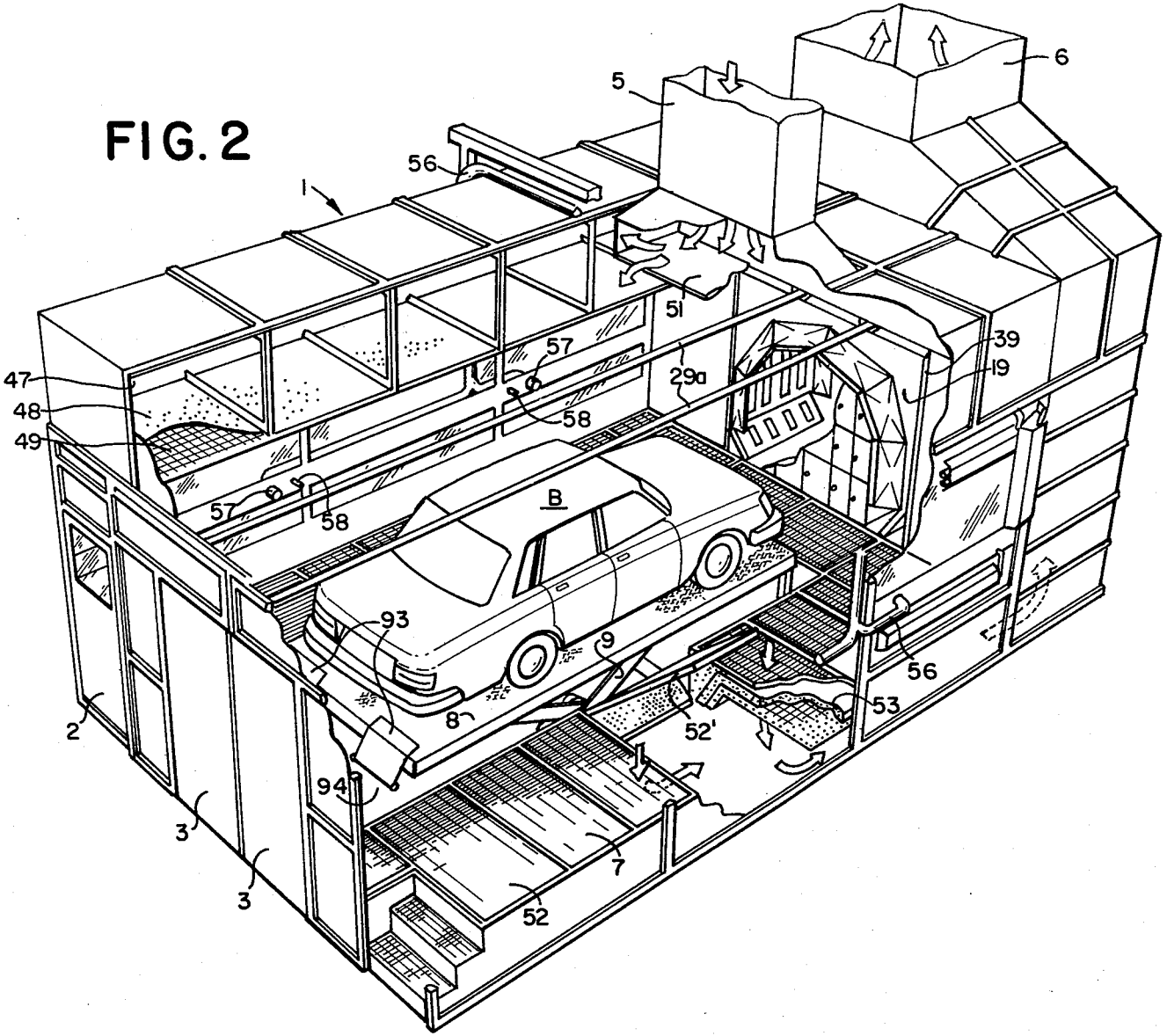
FIG. 2 is a view similar to FIG. 1 with portions of the structure being broken away to illustrate the interior arrangement thereof and to show an automobile body positioned therein.
Figure 3:
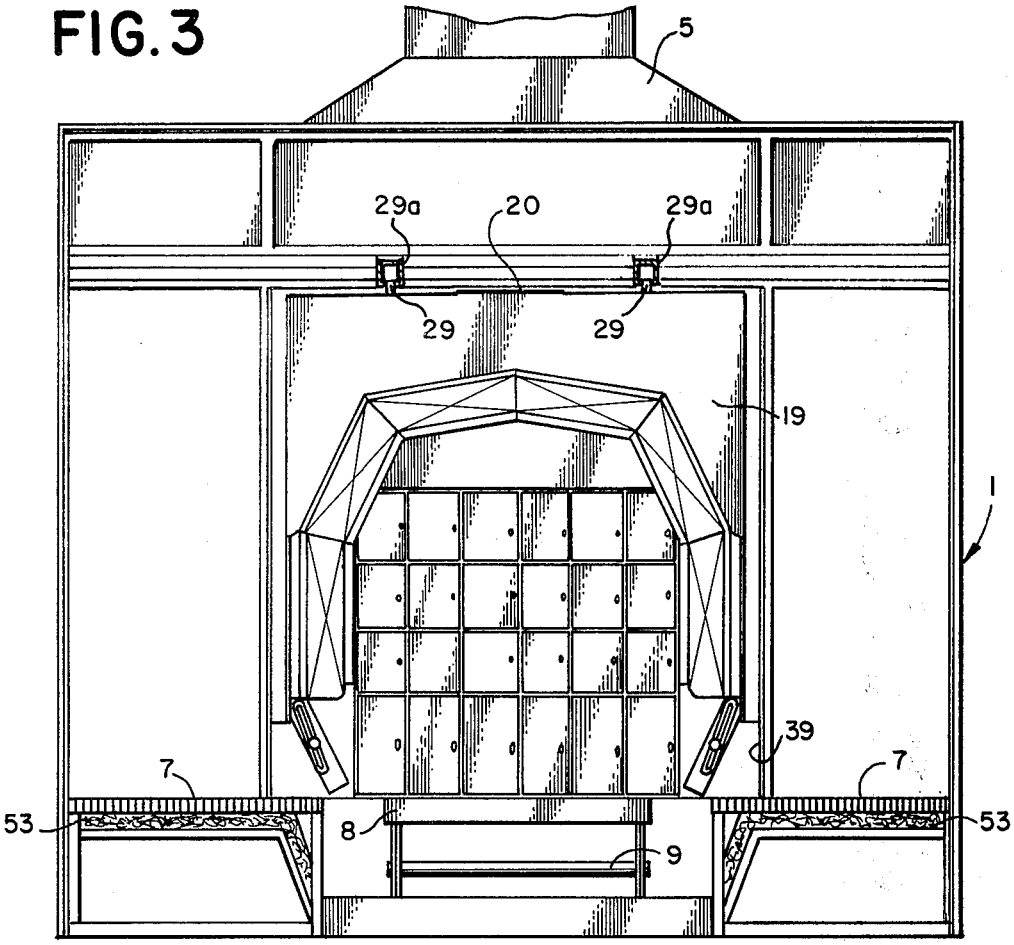
FIGS. 3 and 4 are interior end views of the booth, FIG. 3 showing the carrier in its "home" position and FIG. 4 showing the access doors closed and the rear walkway in position.

With reference to FIGS. 1 and 2, the present invention employs a self-contained treatment booth 1 having access means in the form of personnel doors 2 at one end and work-entry doors 3 centrally at the same end. A control console is provided at 4. An air inlet 5 is provided in the roof adjacent the opposite end and a cooperating air exhaust connection is provided at 6. The work floor 7 extends about the perimeter of the booth to permit workmen to work on the car body B which is supported centrally within the booth. In the present instance the body B is supported on an elevated support platform 8 which may be raised and lowered relatively to the work floor 7 by suitable elevating mechanisms shown at 9.

The work floor 7 extends about three sides of the booth to permit access between the work-entry doors 3 and the platform 8 which is raised and lowered by the elevating mechanism 9. When lowered, the body may roll on or off the platform 8 by way of ramps 93 onto the floor 94 below the level of the walkway 7 for passage through the doorway 3.

Figure 4:
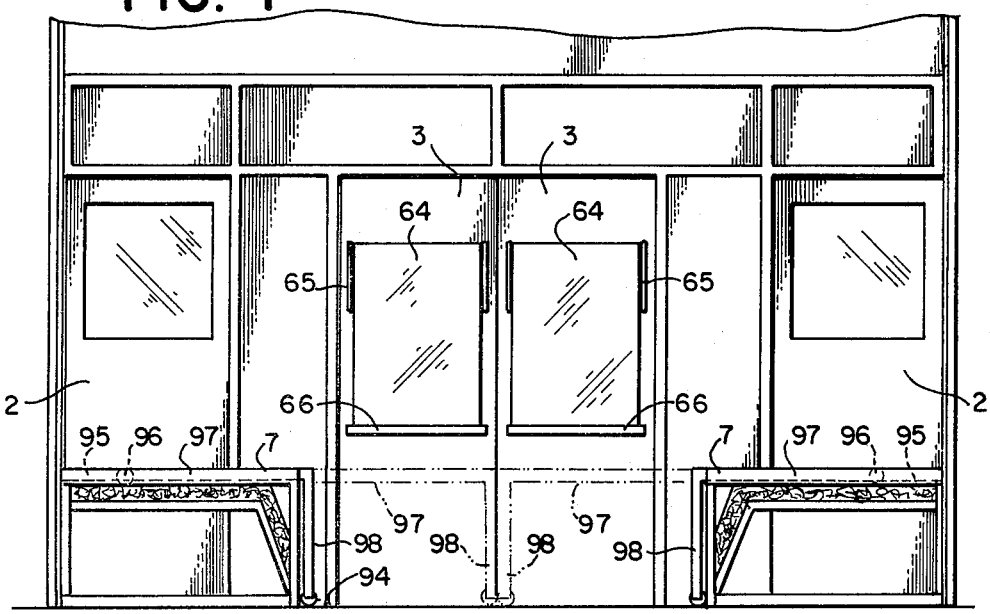
Figure 6:
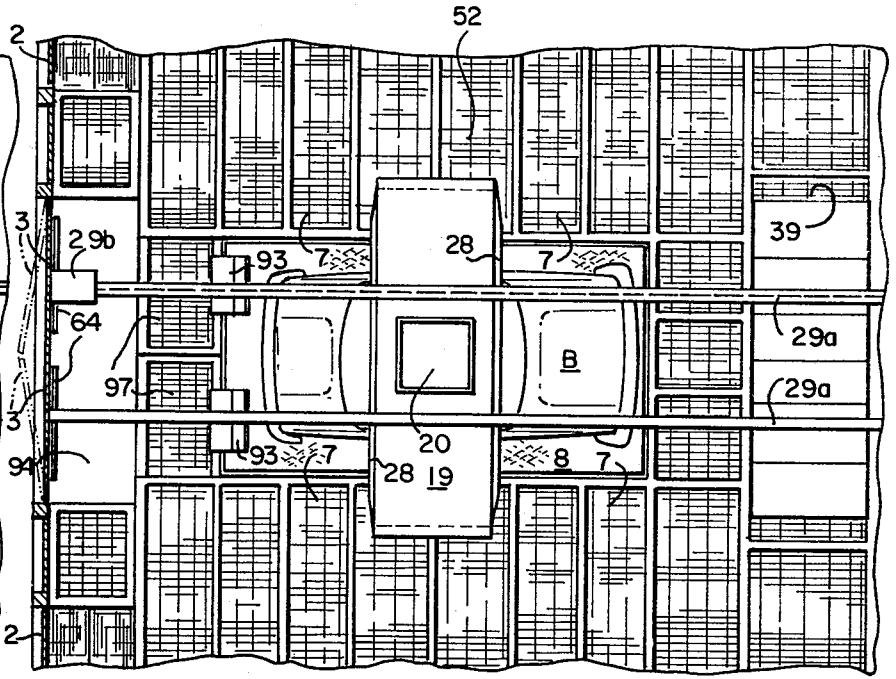
FIGS. 5 and 6 are plan views showing the displacement of the carrier between its home position (FIG. 5) and an operative position (FIG. 6)
Figure 5:
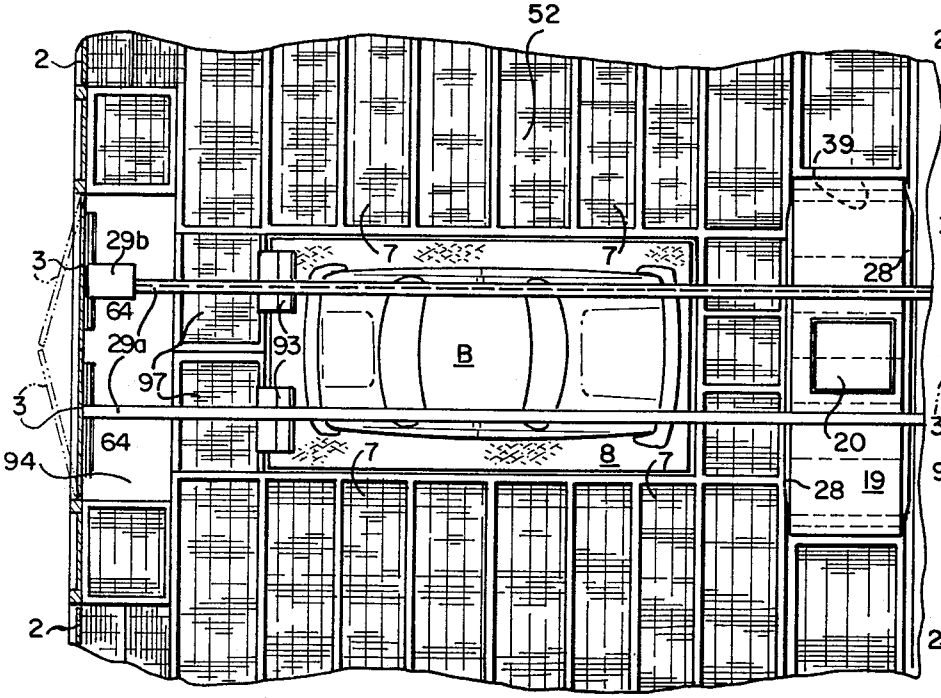
Figure 7:
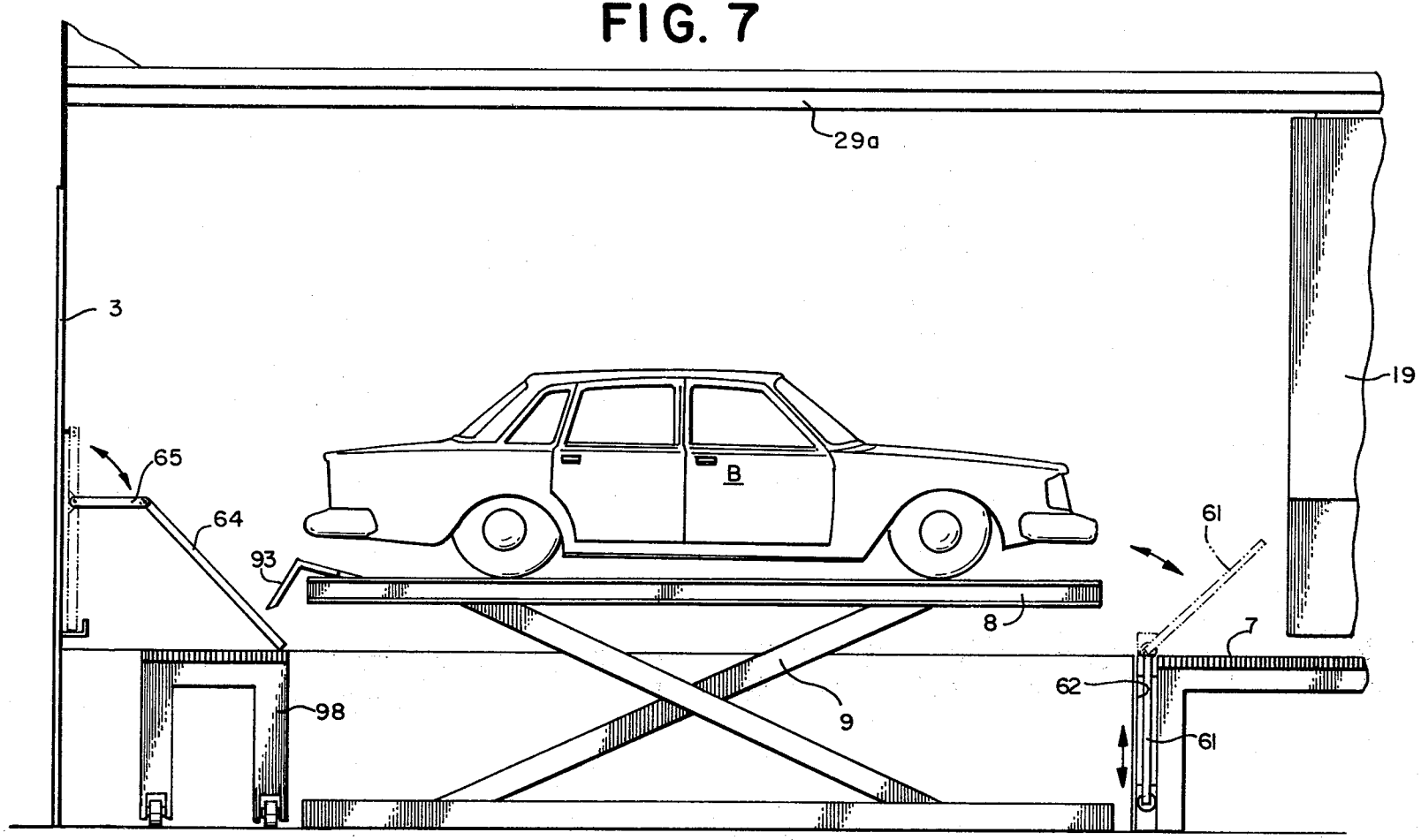
FIG. 7 is a longitudinal section of the booth shown in FIG. 2.

As shown in FIGS. 4 and 7, means is provided to extend the walkway behind the support 8 after the car body has been positioned on the support platform 8. To this end the work floor 7 adjacent the entrance end of the booth 1 is provided with transverse track means 95 for guiding and supporting rollers 96 on a filler section 97 which is displaceable into the space between the elevated work floor parts at the opposite sides of the booth. As shown in FIG. 4, the filler section has a central support leg 98 which nests in a recess 99 in the inwardly directed surface of the structure supporting the floor 7. The support of the section 94 is such that when the section is extended into the area behind the car body B, the top surface of the section 97 substantially flush with the work floor 7. Thus when extended as shown in FIG. 4, the sections 97 provide a continuous walkway about the entire periphery of the booth so as to afford convenient working areas for repairing the car body and performing whatever treatment operations are required. The elevator mechanism 9 permits the platform 8 to be raised and lowered to a convenient working height, and preferably the elevator mechanism is susceptible to be operated by remote controllers held by the workmen.

In repairing a damaged car body, after the body has been hammered into the desired final shape, the dents and other imperfections are filled with a suitable filler material such as 2-component polyesther, filler and the like. Such filler material is moldable and normally requires a predetermined set time in order to harden and become amenable to grinding and subsequent painting, etc. The hardening time may be accelerated by the application of heat and in accordance with the present invention the heat is applied by a controlled radiation from a source of heat radiation. In accordance with the present invention the application of heat radiation is confined to the particular areas which require it and the other areas of the car body are not subjected to the radiation, thereby saving energy otherwise required to generate heat on there other areas. For this purpose, the apparatus includes a carrier mechanism 19 which is displaceable within the booth well over the length of the car body, the carrier mechanism including heat radiation elements arranged in clusters and individually controlled so as to be selectively, single or in group, energized to direct the desired degree of radiation against the car body as the carrier is traversed along the length of the body.

The carrier 19 is designed and the heat radiation sources controlled in such a way so that the energy-flux to the different parts of the body B will result in an equivalent final paint quality independent of the location where the damage has been repaired. The carrier 19 includes heat radiation sources 18 arranged in the interiorly-directed walls of the carrier 19. The radiation sources 18 consist of the infra-red lamps in suitable reflectors, and the carrier contains ducts carrying ventilating air from a ventilator inlet 20 to the radiation sources. The radiator sources are arranged in horizontal and/or vertical groups or rows with a series of elements in each group. These sources may be energized separately by group or individually, as set forth more fully hereinafter. The carrier is mainly designed so as to be substantially uniformly spaced from the profile of the vehicle body B on the platform 8.

The carrier construction contains two side parts 22 and 23, the height of which is less than the height of the vehicle, and two celing parts 24 and 25 arranged at an obtuse angle to each other. Each one not fully covering the maximum height of the vehicle. The side and ceiling parts are joined to each other by two sloping shredded parts 26 and 27.

At the forward and rearward ends of these parts 22–27 inclusive, there are deflectors 28 which are pivotally mounted so that they may be directed inwards 28 covering approximately half of the width of the space 21 within the carrier between the parts and the body B. The deflectors 28 increase the efficiency by preventing radiant energy from reradiating outwardly. The lower part of the side parts 22 and 23 have turnable extensions 22*a* and 23*a* which allow the radiation sources 18*a* therein to be positioned closer to the body B when it is necessary to bring an extra amount of energy to the lower often heavier parts of the car side.

The carrier 19 is equipped with trolley devices (shown in part at 29) having wheels (not shown) which may ride on rails 29*a* in the roof of the surface treatment booth 1 to make it possible to move the carrier along the vehicle body B positioned on the support 8. The control console 4 controls a motor device 29*b* which brings the carrier from a parking or "home" position to the proper working area on the vehicle, i.e. any one or more of the front, middle or rear parts, a door or any other part of the car. The console energizes a sufficient number of radiation sources to the right, to the left, in the lower part or in the upper part of the carrier 19, so that the time period and the radiation intensity produces the desired heat treatment to the material used for the surface treatment. Finally the console 4 brings the carrier 19 back to its parking position as shown in FIG. 2.

The carrier is moved along the vehicle at a velocity determined by the control unit 4. For example, if a door of the car B is going to be retouched, or any other large area, the first radiation lamp 18 in the direction of the movement is energized just before the carrier 19 has come up to the door and thereafter the following lamps are energized in order as the carrier moves along the vehicle. The radiation lamps are then disconnected in order as they pass away from the surface area to be treated in the direction of movement. The repositioning of the carrier to its home position can be made very quickly with the infra-red lamps being disconnected. It is also possible to effect the return at a lower speed and energize and disconnect the lamps 18 in reverse sequence to obtain a second heat treatment.

The control unit 4 can also be programmed to treat a small area without movement of the carrier. According to such a program the unit 4 brings the carrier 19 from its parking or "home" position to a predetermined position over the vehicle, i.e. front or rear part, door or any other part, and energizes the necessary number of radiation sources, to the right, to the left, down or up, as determined by the time period and radiation intensity needed by the medium used for the surface treatment, and finally brings the carrier back to the parking position.

The booth 1 and the carrier 19 are ventilated before, during and after the heat-treating process. Preferably air is circulated through the booth by connecting the inlet 5 to the exhaust of an air blower and connecting the exhaust 6 to the suction of a second blower. Adjustable baffle plate 51 underlies the inlet 5 to assure the desired distribution of air throughout the booth, and limit noise transmission.

As indicated in FIG. 2, the air inlet 5 directs pressurized air into the ceiling area of the booth 1 which is formed as a plenum chamber 47 between the opposite walls. The undersurface of the plenum chamber 47 is formed of a grid or grill 48 having a suitable filter medium 49 for excluding entry of foreign matter into the work area of the booth. The work floor 7 of the booth is likewise formed with grid work sections 52 so that air may be exhausted downwardly through the floor. A suitable filter medium 53 is positioned below the floor to entrap particulate matter and prevent it from interfering with the exhaust mechanism. As indicated at 52', the floor sections 52 may be removed to provide access to the filter medium 53 for removal and replacement.

To supplement the flow from the inlet 5 to the exhaust 6, a supplemental conduit system 56 is provided externally of the booth 1 and is provided with vents 57 and 58 for introducing and exhausting additional air, preferably for pollution control. It is noted that the vents are provided in themid-portion of the window-walls of the booth which are provided to afford visual comunication between the workers inside the booth and personnel outside the booth. The flows of the fans feeding to the inlet 5 and from the exhaust 6 and the flow through the supplemental system 56 are maintained at the level necessary to provide a laminar flow of air issuing from the grill 48 and flowing into the grid sections 52 so as to avoid air turbulences which might adversely affect the treatment undergoing upon the car body on the booth.

Figure 8:
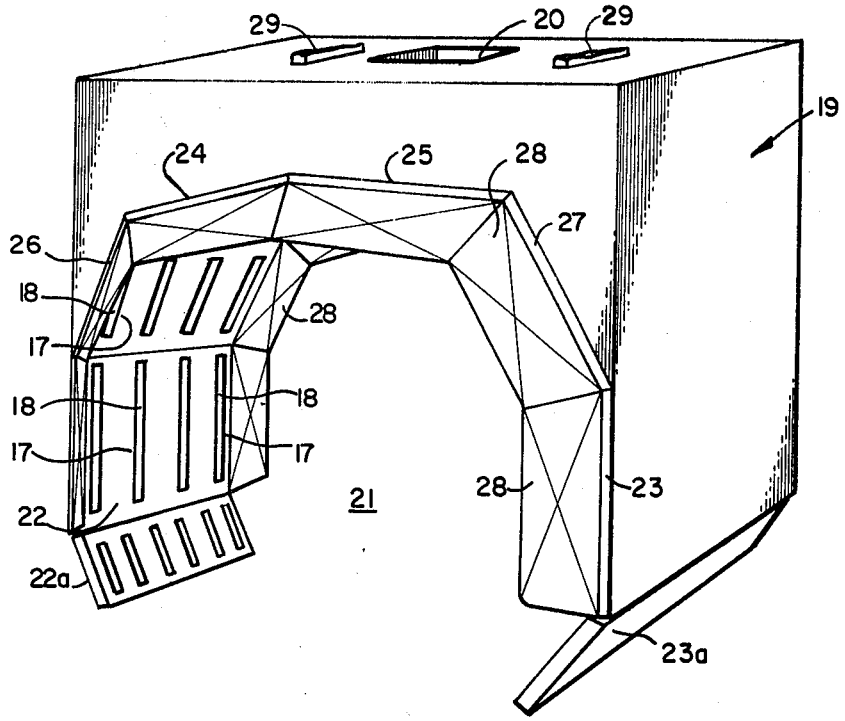
FIG. 8 is a perspective view of the carrier.

Ventilation air is also caused to flow through the carrier 19 in which way the infra-red elements or other heating elements are protected from the paint solvents or solvent vapours emitted during the drying or precuring. Thereby creating a ventilated zone in order to prevent direct contact between the solvent vapours and the elements which might otherwise create fire or explosion. FIG. 8 shows a preferred embodiment, in which the carrier 19 containing infra-red radiators and/or heating-elements and air nozzles is traversed over a car by means of the driving motor **29*b*. Ventilation air is supplied from the open bottom of the plenum 47 through a filter 43 which air enters the carrier through the inlet 20. Air is supplied as indicated by the arrows 44 along the infra-red radiators and/or heating-elements 18 from nozzles or slots 17 between the elements 18 and is discharged in a laminar air flow indicated by the arrows 45 towards the body B. In the supply air channel 20 to the carrier, a fan 46 is installed to promote the laminar air flow between the reflectors 32** during the operation.

When the heat-treating process is concluded, the carrier is moved to its "home" recess 39, which is ventilated by air from the inlet 5 and which is under slight over-pressure in relation to the booth. Thus, ventilation air emerges from the parking recess 39 and into the booth through specially-designed slots, which prevent particulate matter and solvent vapours from entering the carrier, when grinding, filling and paint spraying or final drying are accomplished in the booth. During such processes, a given air flow is supplied to the parking recess 39 and emerges through the clearance surrounding the carrier 19 to ensure that no evaporated solvents enter this space. It is noted that the end wall of the booth closely surrounds the parking recess 39 on both its inside and outside surfaces, so that the reflectors are not exposed to the working space in the booth when in the "home" position. Suitable equipment lockers may be installed in this end wall.

When the carrier 19 is stationed in the parking recess 39 as shown in FIG. 2, and ventilation air from the plenum 47 is also supplied to the channel 20 in the carrier. This air ensures outward flow from the carrier, so that particulate matters and solvent vapours cannot enter the carrier during grinding, filling or paint spraying. The ventilation air from the carrier is also conducted away from the parking recess by specially designed slots to insure that particulate matters paint, solvents or solvent vapours cannot reach the carrier 19 during grinding, filling or paint spraying. Thus, an otherwise possible risk of explosion when energizing the infra-red radiators or heating-elements is avoided.

The control unit 4 comprises a preset program for adjusting the baffle plate 51 and initiating and terminating the operation of the ventilating system, and for switching on the radiation sources within different parts of the tunnel-shaped carrier as well as allowing the radiating sources to be controlled as to intensity and duration to a level between the highest and the lowest temperature allowable relating to the duration of the heat treatment. A manual override of the program is included in the unit.

Figure 15:
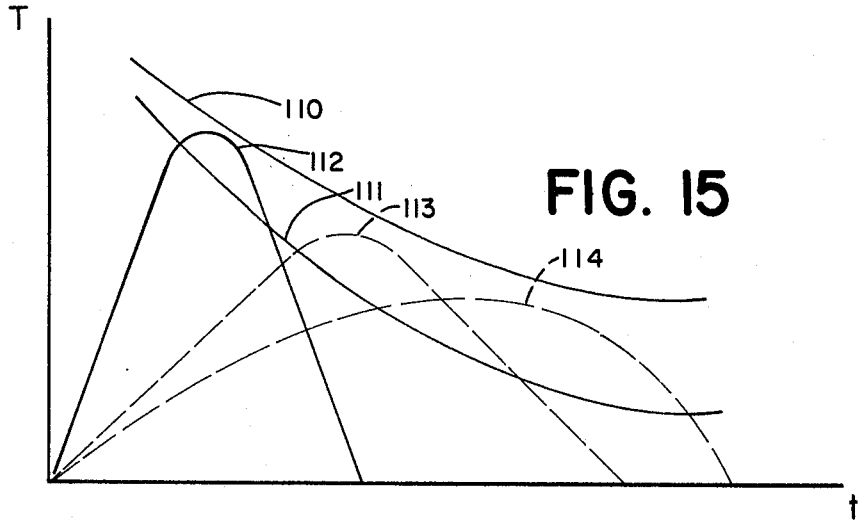
FIG. 15 is a graph illustrating the temperature requirements according to the invention and according to the prior art methods.

FIG. 15 is a graph illustrating these levels for the accelerated curing of paint on an automobile body. In the figure, the abscissa represents the heat-treatment time (t) and the ordinate the body temperature (T). The curve 110 sets forth the highest possible temperature for a specific quality in order not to obtain to hard a curing with the risk or causing bubbles or pin-holes. The lower curve 111 sets forth minimum temperature necessary to supply a minimum amount of heat in order to have the paint cured.

According to the invention, the time/temperature relation should follow a curve like 112, which means that the treatment is carried through in a relatively short time at a correspondingly high temperature. Curve 113 illustrates a conventional infra-red drying process and curve 114 illustrates a drying-procedure in a convection-type oven.

It is obvious and well known that the time consumption in the both cases is considerable and even if the temperature is kept at a medium level the total heat requirement is considerable. As each repair operation requires several consecutive process steps followed by the drying cycle, the total repair is time-consuming and thereby expensive. As a comparison it can be mentioned that conventional drying time is 15–60 minutes. It is possible according to the invention to obtain the same result in a heat treatment cycle less than 4 minutes, but usually 1–2 minutes. In a repair operation it is not necessary to dry or bake the touch-up paint thoroughly but to force the drying procedure by quickly evaporating the solvents and to start the baking process so that the consecutive treatment can follow. Furthermore, the diffusion of the residual heat allows the heat also to penetrate into hidden areas of the body and its framing to effect complete heat treatment as needed.

When working in the higher temperature region according to curve 112 it is necessary to position the radiation sources in such a way that during the short time interval available, it is possible to achieve a homogeneous heating of the different surfaces independent of their position in relation to the carrier for the heat sources.

Figure 11:
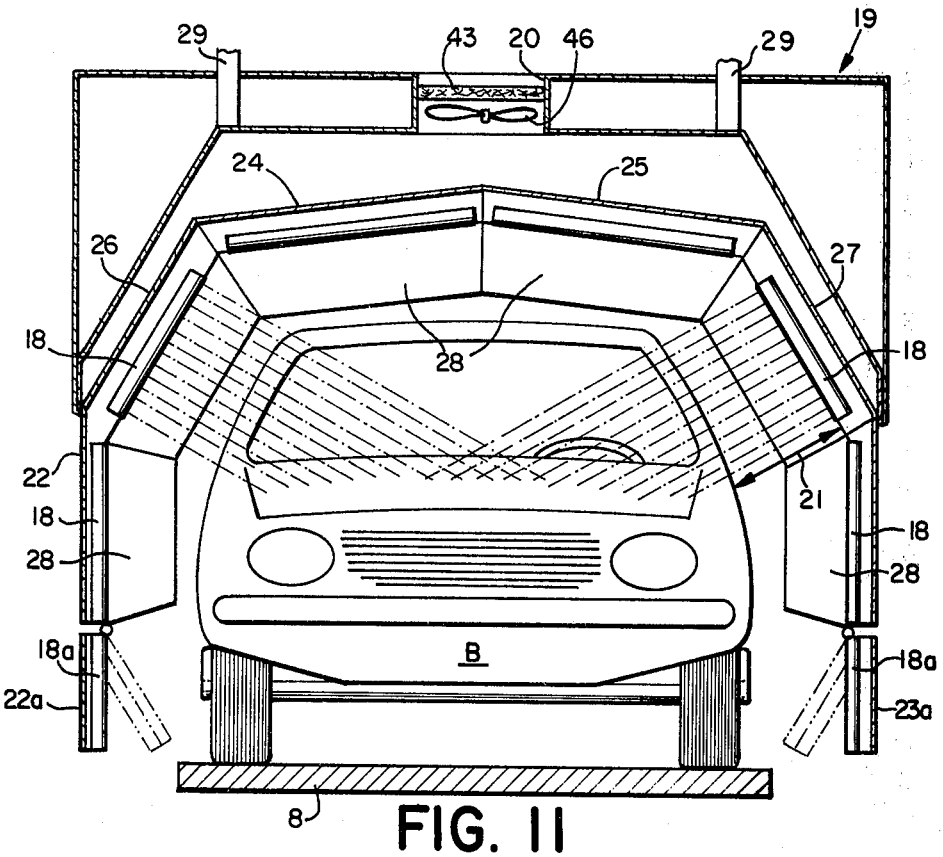
FIG. 11 is a sectional view through the carrier showing the transfer of radiant energy to a car body.
Figure 9:
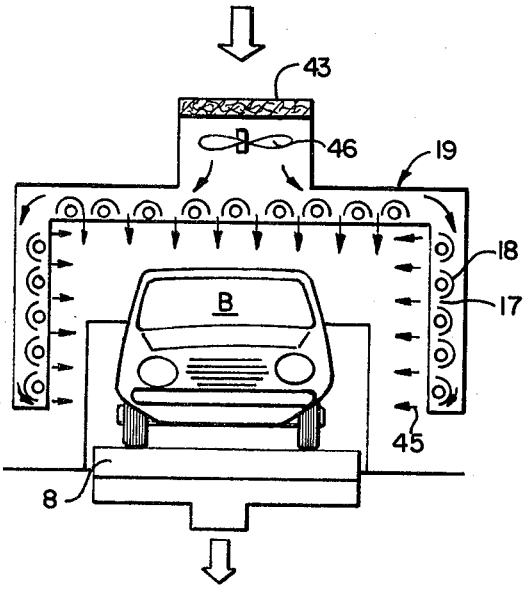
FIG. 9 is a diagramatic sectional view through the carrier showing the flow of the ventilating air therein.

As had been said above it is in the first instance the relation between the roof of the car and hood and booth lid that causes the biggest difficulties when trying to achieve a uniform temperature distribution. One correct design which is supposed to be suitable for the treatment of cars is shown in FIG. 11. The hood 15 on the vehicle B is of a conventional type and is situated at lower level than the roof 17 of the vehicle. The same being the case for the trunk lid. It is therefore desirable to design the carrier construction in a way so that the energy-flux at the body surface to the different parts of the body will be approximately the same. The two shredded parts 26 and 27 are positioned and dimensioned so that each of them can irradiate at least half of the width of the hood 15. In spite of its fairly low position below the ceiling parts 24 and 25 it will achieve sufficient irradiation from the two ceiling parts 24 and 25 and the shedded parts 26 and 27.

As the task seldom is to refinish the whole car body and the radiation sources 18, 18*a* and the different parts 22–27 are connected to the preprogrammed control unit 4 which controls the radiation sources for a given job. As said before in connection to the extensions 22*a* and 23*a*, it can be necessary to arrange for different radiation intensities at the different parts. For example, sound absorbing pads inside the door can make it necessary to bring an extra amount of heat from the side parts 22, 23 in comparison with that from the celing parts 24 and 25. The time and the radiation intensity is related to the material used for the surface treatment. The reflectors are designed to spread the radiation emitted in a given array. For example the reflectors may be elliptical, parabolic, or of another configuration designed to produce the desired diffusion of the energy.

Figure 10:
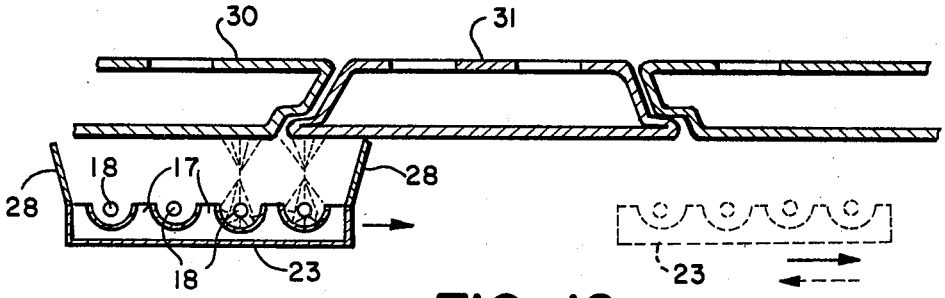
FIG. 10 is a frgmentary view showing a typical cross-section of a car body door.

FIG. 10 is a schematic a cross-section through a side-part of a vehicle wall 30 containing a door 31. The four infra-red radiation sources 18 are mounted in reflectors 32 designed to give a certain diffusion of the radiation, e.g. elliptical. In treating the vehicle wall 30, the carrier 19 is moved along the vehicle at a speed determined by the control unit 4. After the door 31 has been repaired and painted, the first infra-red radiation source 18 is energized just before the carrier 19 has come up to the door, and after that, the following radiation sources are energized in order as the carrier moves along. The radiation sources are then extinguished in opposite order as they pass the opposite edge of the door. The end position of the carrier is marked by dashed lines at 33.

To facilitate heat treatment of the lower parts of the front and back of the body B, reflector means are provided at each end of the platform 8. At the forward end, a flat reflector 61, for example made of aluminium sheet, is housed in a vertical slot 62 in the walkway 7 immediately in front of the elevator platform 8. The reflector has a suitable hand hold (not shown) to enable it to be raised from its housing 62 to the broken-line position, which is inclined at about 30°. With the elevator platform 8 positioned level with the floor 7, as is the case during heat treatment, the reflector 61 is effective to reflect the radiant energy directed in front of the body B back to the lower part of the front of the body. During the hammering and spraying operations, the reflector is re-housed in its housing 62 and suitable sealing means is provided to exclude particulate matter and vapors from the reflector in the housing.

At the rear of the platform 8, a similar reflector 64 is mounted on the work-entry doors 3. In the present instance a separate reflector element 64 is mounted on each door. As shown in FIGS. 4 and 7, the reflector is supported by a strut 65 pivoted to the door 3 at one end and pivoted to the top of the reflector 64 at the other end. The strut 65 permits the reflector 64 to be folded against the door as shown in broken lines, and a channel 66 is provided to retain the reflector 64 in its folded position on the door. When folded out as shown in full lines in FIG. 7, the bottom edge of the reflector 64 is supported on the filler sections 97 adjacent the rear end of the platform 8. The reflector 64 functions like the reflector 61 to reflect radiant energy which is directed beyond the end of the car body B backwardly toward the lower part of the rear of the body.

Figure 12:
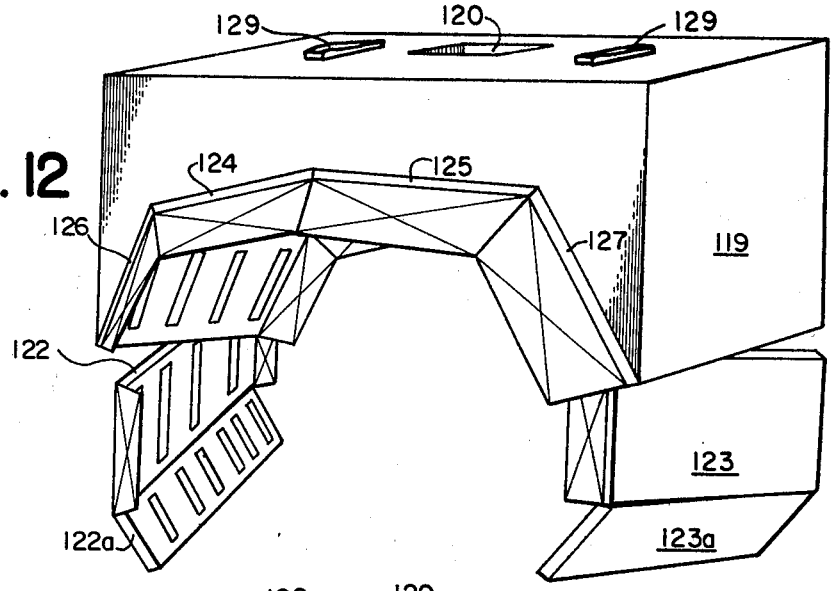
FIG. 12 is a fragmentary view of a modified carrier in which the lower portions of the carrier are mounted for pivotal movement relative to the upper portions.
Figure 13:
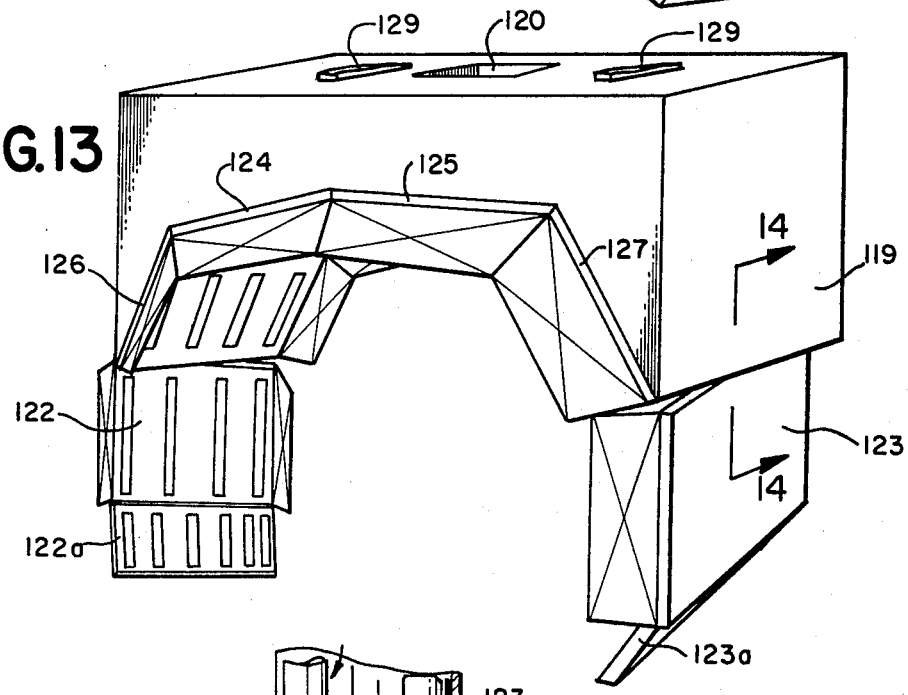
FIGS. 13 and 14 are additional views illustrating the pivotal connection of FIG. 11.
Figure 14:
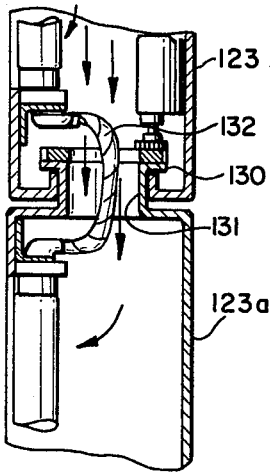

An alternate form of carrier is shown in FIGS. 12, 13 and 14. In this embodiment, the carrier parts 122 through 127 inclusive are similar to the parts 22 through 27 described above in connection with FIG. 8. In this embodiment, however, the parts 123 and 123*a* are mounted for pivotal movement about a vertical axis relative to the part 127, and the parts 122 and 122*a* are mounted for pivotal movement on the part 126. As shown in FIG. 12, the lower parts may be rotated so as to provide a direct radiation upon the front and rear parts of the body B as the carrier is traversed over the body. The rotary movement of the lower parts of the carrier may be controlled by conventional servo-motor mechanisms from the controller 4 so that the lower parts are directed towards the front of the body B as the carrier advances towards the platform and then are turned parallel to the body as the carrier passes over the body and finally are turned towards the rear of the body as the carrier passes beyond the body. As shown in FIGS. 13 and 14, the pivotal connection between the lower parts and the upper parts is provided by a bearing 130 which has an opening 131 affording air passage between the parts and also passage of a conductor 132. The conductor 132 permits control of the sequencing and intensity of the infra-red radiators as was discussed above in connection with the carrier 19 and air passage 131 is provided to permit ventilation around the reflectors in the lower parts as is provided around the reflectors in the carrier 19.

The program for the controller 4 is preferably designed so that the operator may select any paint-type or part of any one of a given set of, for example 99, car models, and the programmed controller will thereby accomodate the controls to properly treat the selected model. Likewise individual controls are provided for selecting particular portions of the body which may require treatment so that the operator may simply select the desired part of the body which is being repaired and the controller will confine the treatment to that particular part of the body and not waste energy treating undamaged parts of the body. Suitable interlocks are provided to ensure that personnel are out of reach from infra-red radiation when the carrier is actuated to initiate its traverse over the car body and the advance of the carrier is precisely controlled so that the selective operation of the infra-red radiators is effective to treat the desired parts of the automobile body positioned on the platform. Suitable guides (not shown) ensure that the car is properly positioned on the platform and pollution sensors may be provided to ensure that the vapours from solvents and other treating materials are completely exhausted from the booth before the radiators are energized.

The illustrated embodiment shows a single booth with a parking area for the carrier at one end. It is apparent that the same carrier may be used for two or more booths which may be positioned end to end with the parking recess of the carrier in the space between the two or more booths. Thus the carrier may be used to heat treat a body in one booth while the other operations are being performed on a body in the other booth, and vice versa. With appropriate modification the same carrier may also be operated to treat more than two booths.

While particular embodiments of the present invention have been herein illustrated and described it is not intended to limit the invention to such disclosures but changes and modifications may be made therein and thereto within the scope of the following claims.

We claim:

1. Apparatus for surface treatment in a booth adapted for application of a surface treatment material to a body comprising:

a traversable carrier in said booth containing means for controlled energy transfer to said body;

said means in said carrier being in groups, with at least one element in each group, each group having a separate energy supply;

flow means adjacent said energy-transfer means to direct ventilating medium from said carrier toward said body;

means to position said body at a predetermined work area in said booth;

a parking area for receiving said carrier when not in use;

means to drive said carrier from said parking area to traverse said work area and return said carrier to said parking area;

ventilating means to supply ventilating medium to said carrier and to exhaust spent ventilating medium from said booth; and control means to actuate said drive means and to operate said separate energy supplies to supply heat to a selected area of said body during said traverse, in a way that is specific to the treating material used, the specific part of the body and the specific body.

2. Apparatus according to claim 1 wherein said carrier comprises a tunnel adapted to the profile of the body, said heating elements comprising a number of heating sources positioned on the interior of said tunnel directed towards the body treated, to strive for substantially uniform heating of the body parts.

3. Apparatus according to claim 1 for treating a body having at least two approximately horizontal surfaces at different levels, wherein said carrier includes a ceiling part with less than the maximum width of the body, and two inclined parts, connecting the ceiling part with the side parts, said parts together covering the profile of the body above the ground-plane with substantially uniform spacing, the inclined parts being so positioned and dimensioned that each of them irradiates at least half of width of the lower surface.

4. Apparatus according to claim 3 wherein the ceiling part of the carrier is divided in the longitudinal direction into two parts meeting in an edge with an obtuse angle.

5. Apparatus according to claim 3 wherein the lower part of each side part of the carrier has an extension mounted for movement around a horizontal axis and carrying heating elements.

6. Apparatus according to claim 3 wherein each side or a part of the carrier are mounted for pivotal movement in a bearing having an upright axis.

7. Apparatus according to claim 6 wherein said bearing includes means affording energy connections to the heating elements in each side of the carrier or a part thereof.

8. Apparatus according to claim 3 including screens directed angularly inwards.

9. Apparatus according to claim 1 including track means for guiding said carrier in linear movement in the traverse between said parking and work areas.

10. Apparatus according to claim 1 wherein said means for the controlled energy transfer comprise radiation sources mounted in reflectors to spread a bundle of rays into a given array.

11. Apparatus according to claim 1 wherein said parking area comprises:

a parking recess for receiving said carrier when it is not in use; and means to cause ventilation air to flow through said recess, said recess and carrier providing specially designed slots for exhausting the ventilation air into the booth so as to prevent contamination of said carrier when it is in said recess.

12. Apparatus according to claim 1 wherein said booth includes reflector means respectively in front of and behind said work area in the direction of traverse to thereby reflect heat from the carrier passing in front of or behind the body back against said body.

13. Apparatus according to claim 1 wherein:

said energy-transfer means comprise heating elements energized by said control means;

said flow means comprise air nozzles adjacent said heating elements; and said ventilating means is operative during energization of heating elements to exhaust ventilating medium through said nozzles around said body.

14. Apparatus according to claim 13 wherein said carrier has ventilation air channels and nozzles providing flow towards and around the body.

15. Apparatus according to claim 13 including means in the sides of the booth for the extraction of dustladen air.

16. Apparatus according to claim 1 wherein a locker, preferably a tool cabinet, is located within the parking space of the carrier to follow the interior contour of the carrier and providing a throughgoing slot as an overpressure zone.

* * * * *